US010539369B2

(12) United States Patent
Böhn

(10) Patent No.: US 10,539,369 B2
(45) Date of Patent: Jan. 21, 2020

(54) HEATING SYSTEM FOR WARMING A GASEOUS TREATMENT MEDIUM FOR A DRYER

(75) Inventor: Markus Böhn, Hainburg (DE)

(73) Assignee: TRUETZSCHLER NONWOVENS GMBH, Egelsbach (DE)

( * ) Notice: Subject to any disclaimer, the term of this patent is extended or adjusted under 35 U.S.C. 154(b) by 378 days.

(21) Appl. No.: 14/346,117

(22) PCT Filed: Aug. 14, 2012

(86) PCT No.: PCT/EP2012/065887

§ 371 (c)(1),
(2), (4) Date: Mar. 20, 2014

(87) PCT Pub. No.: WO2013/041306

PCT Pub. Date: Mar. 28, 2013

(65) Prior Publication Data

US 2014/0223765 A1 Aug. 14, 2014

(30) Foreign Application Priority Data

Sep. 21, 2011 (DE) ..... 10 2011 113 837

(51) Int. Cl.
*F26B 19/00* (2006.01)
*F26B 13/14* (2006.01)
(Continued)

(52) U.S. Cl.
CPC ..... *F26B 13/14* (2013.01); *F26B 21/001* (2013.01); *F26B 21/04* (2013.01)

(58) Field of Classification Search
CPC ..... F26B 13/14; F26B 13/16; F26B 21/01; F26B 21/004; F26B 21/04; F26B 3/00; D21F 5/20
(Continued)

(56) References Cited

U.S. PATENT DOCUMENTS 2,032,135 A * 2/1936 Lee ..... F27B 7/36 110/104 R
3,495,949 A * 2/1970 Niedner ..... B01F 5/0068 159/4.04
(Continued)

FOREIGN PATENT DOCUMENTS

CN 1729378 A 2/2006
DE 39 32 837 A1 9/1989
(Continued)

OTHER PUBLICATIONS

European Search Report, dated Mar. 24, 2017, for corresponding European Application No. 16203016.7-1664, and English translation thereof.
(Continued)

*Primary Examiner* — John P McCormack
(74) *Attorney, Agent, or Firm* — FisherBroyles, LLP; Robert Kinberg

(57) ABSTRACT

The invention relates to a heating system (38) for warming a gaseous treatment medium (30, 40) for a device for treating a preferably strip-shaped article (12) by means of a gaseous treatment medium (40), comprising a heating device, a mixing chamber (54) for mixing at least one first, gaseous heating medium (49) heated by means of the gas burner, and the gaseous treatment medium (30) already used for treatment and recycled by the device. Said gaseous heating medium (49) can be introduced into the mixing chamber (54) such that when the gaseous medium (49) is introduced into the mixing chamber (54), vortexes are produced in the mixing chamber (54), which generate an intensive thorough-mixing of the gaseous heating medium (49) with the recycled gaseous treatment medium (30).

10 Claims, 5 Drawing Sheets

Figure 1:
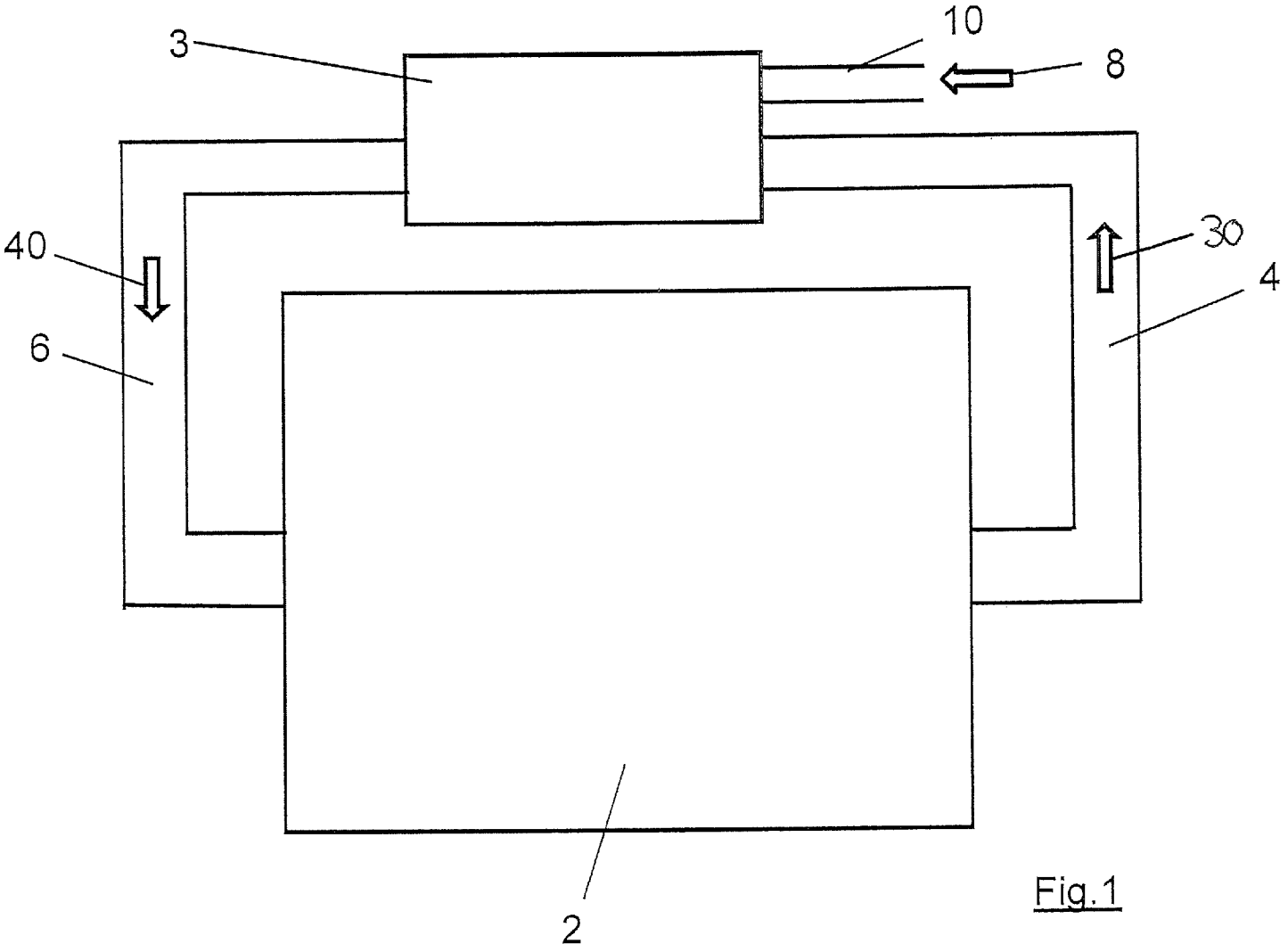

(51) Int. Cl.
*F26B 21/04* (2006.01)
*F26B 21/00* (2006.01)

(58) Field of Classification Search
USPC ..... 34/241, 477, 72, 83, 86, 639, 665, 487, 34/326, 376, 377, 498, 508, 102; 431/181, 182, 185, 187, 278, 284, 116, 431/115, 12, 9, 8, 169, 168, 217, 354
See application file for complete search history.

(56) References Cited

U.S. PATENT DOCUMENTS 3,869,808 A * 3/1975 Sawyer ..... F16B 21/00 34/124
4,291,669 A * 9/1981 Herne, Jr. ..... F23M 9/00 110/214
5,033,207 A * 7/1991 Sturm ..... B65H 23/24 34/115
5,150,535 A 9/1992 Fleissner
5,685,706 A * 11/1997 Hersh ..... B05B 7/0483 431/354
5,937,538 A 8/1999 Joiner
5,937,539 A 8/1999 Takahashi
9,039,407 B2 * 5/2015 McKnight ..... F23C 6/045 431/36
9,861,934 B2 * 1/2018 Valentine ..... B01D 53/8631
2006/0150434 A1 * 7/2006 Rydell ..... F26B 13/101 34/241

FOREIGN PATENT DOCUMENTS

DE 38 32 632 A1 4/1990
DE 3832632 A1 4/1990
DE 43 04 244 A1 8/1993
DE 4304244 A1 8/1993
EP 0 421 182 A2 4/1991

OTHER PUBLICATIONS

Office Action for Chinese Patent Application No. 201280045913.4 dated Jun. 16, 2015.

* cited by examiner

HEATING SYSTEM FOR WARMING A GASEOUS TREATMENT MEDIUM FOR A DRYER

The invention relates to a heating system for warming a gaseous treatment medium for a device, preferably a dryer, for the treatment of a preferably web-shaped material with a gaseous treatment medium, as well as to a device, preferably a dryer, for the treatment, in particular the drying, of a preferably web-shaped material, in particular a textile material web, and to a method for warming a gaseous treatment medium for a device for the treatment of a preferably web-shaped material.

The previously known heating systems are most often used for dryers for drying a preferably web-shaped material. The heating systems serve to warm a gaseous treatment medium with which a preferably web-shaped material can be dried within a drying chamber of the dryer. Such a system often has a gas burner as the heating means. The cooled treatment medium recirculated from the drying chamber is warmed up by being mixed with a heating medium warmed by the heating means. The mixture is then supplied to the drying chamber as a warmed gaseous treatment medium for the drying of the web-shaped material. In recent years, however, there has been an ever increasing need for more efficient heating systems so that energy can be saved.

Therefore, it is an object of the present invention to provide a heating system and a device, as well as a method for warming a gaseous treatment medium that requires less energy and is thus more efficient.

The invention advantageously provides that the gaseous heating medium can be introduced into the a mixing chamber such that upon introducing the gaseous heating medium into the mixing chamber, turbulences occur in the mixing chamber that cause an intensive mixing of the gaseous heating medium with the recirculated gaseous treatment medium.

This is advantageous in that the hot gaseous heating medium can be mixed better with the recirculated gaseous treatment medium. Due to the flow control, a better mixing of the gaseous heating medium and the gaseous treatment medium is achieved without the necessity of installing additional obstacles. As a consequence, low pressure losses occur in the system and the blower power required for the circulation of the gaseous treatment medium can be reduced. Moreover, hot strands are avoided that lead to a non-uniform temperature distribution within the process.

Upon introducing the gaseous heating medium into the mixing chamber, the gaseous heating medium may be deflected by means of guiding elements so that turbulences occur in the mixing chamber as the gaseous heating medium is introduced into the mixing chamber.

The guiding elements may be vane or blade elements.

The heating means may be a gas burner, a thermal oil heating or an electric heating.

The gaseous heating medium may comprise a mixture of fresh air and combustion exhaust gas of the gas burner. When an electric heating or a thermal oil heating is used, the gaseous heating medium may be the fresh air warmed by the electric heating or the thermal oil heating, or it may be a mixture of fresh air and gas warmed by the electric heating or the thermal oil heating.

A pre-chamber may be provided for mixing the fresh air with the combustion exhaust gases of the gas burner. When an electric heating or a thermal oil heating is used, a pre-chamber can be provided for mixing the fresh air and the gas warmed by the electric heating or the thermal oil heating.

The pre-chamber is preferably arranged within the mixing chamber. This is advantageous in that the exhaust heat from the pre-chamber can be used to warm the gases in the mixing chamber.

The gaseous treatment medium recirculated from the device, preferably the dryer, can be introduced into the mixing chamber such that turbulences occur in the mixing chamber when the recirculated treatment medium is introduced into the mixing chamber.

This also results in an improved mixing of the recirculated treatment medium with the gaseous heating medium.

The turbulences in the recirculated gaseous treatment medium may rotate in a sense of rotation opposite to that of the turbulences in the gaseous heating medium supplied into the mixing chamber. This leads to a further improved mixing of the two gaseous media.

The mixing chamber preferably comprises a cylindrical interior, the recirculated gaseous treatment medium being adapted to be introduced tangentially into the cylindrical mixing chamber so that turbulences occur in the mixing chamber when the recirculated gaseous treatment medium is introduced into the mixing chamber.

As the recirculated gaseous treatment medium is introduced into the mixing chamber, the recirculated gaseous treatment medium can be guided by guiding elements so that turbulences occur in the mixing chamber when the recirculated gaseous treatment medium is introduced into the mixing chamber.

Downstream of the mixing chamber, seen in the flow direction, a flow straightener can be arranged that straightens the flow of the warmed gaseous treatment medium. The heated gaseous treatment medium is the mixture of gaseous heating medium and recirculated gaseous treatment medium.

The flow straightener may be a channel extending in the flow direction, the straightener having flow guiding plates for straightening the flow of the gaseous treatment medium. The flow guiding plates are aligned with the flow direction within the channel.

The flow straightener may be a screen or a perforated plate arranged in the cross-sectional area of the channel.

According to the present invention, a device, preferably a dryer, may be provided for the treatment, in particular the drying, of a preferably web-shaped material. Specifically, the web-shaped material is a textile material web. The device can include a treatment chamber through which the material to be dried can be passed. The gaseous treatment medium present in the treatment chamber flows through the web-shaped material. The device may be a dryer and the web-shaped material can be dried by means of the gaseous treatment medium flowing through the same. However, the device may also be a thermobond device, and the web-shaped material can be thermobonded by the through-flow of the gaseous treatment medium.

Further, the device comprises a heating system for heating the gaseous treatment medium. The heating system comprises a heating means and a mixing chamber, wherein a gaseous heating medium warmed by the heating means and a gaseous treatment medium recirculated from the treatment chamber can be mixed in the mixing chamber. According to the present invention, it is preferably provided that the gaseous heating medium can be introduced into the mixing chamber such that turbulences occur in the mixing chamber when the heating medium is introduced into the mixing chamber, the turbulences causing an intensive mixing of the gaseous heating medium with the recirculated gaseous treatment medium.

The heating system can be arranged outside the treatment chamber.

Further, according to the present invention, a method may be provided for heating a gaseous treatment medium for a device, preferably a dryer, for the treatment, in particular the drying, of a preferably web-shaped material by means of a gaseous treatment medium, the method comprising the following steps:

- recirculating a gaseous treatment medium already used for the treatment of the material,
- introducing the recirculated gaseous treatment medium into a mixing chamber,
- introducing a warmed gaseous heating medium into the mixing chamber to heat the recirculated gaseous treatment medium, the gaseous heating medium being adapted to be introduced into the mixing chamber such that turbulences occur that cause an intensive mixing of the gaseous heating medium with the recirculated gaseous treatment medium.

Further, the present invention provides a method for heating a gaseous treatment medium for a device, preferably a dryer, for the treatment, in particular the drying, of a preferably web-shaped material by means of a gaseous treatment medium, the method comprising the following steps:

- introducing a heated gaseous treatment medium into a treatment chamber in which a drum with a gas-permeable drum shell is arranged on which the web-shaped material to be treated can be placed, the gaseous treatment medium flowing through the web-shaped material and the gas-permeable drum shell into the interior of the drum,
- discharging the gaseous treatment medium, which has already been used for treatment, as a recirculated gaseous treatment medium from the interior of the drum and from the treatment chamber to be processed externally of the treatment chamber,
- processing the recirculated gaseous treatment medium, the recirculated gaseous treatment medium being processed by being mixed with and warmed up by fresh air, and
- supplying the processed gaseous treatment medium to the treatment chamber.

In previous prior art, the gaseous treatment medium is often warmed within the treatment chamber. Likewise, in previous prior art, the exhaust air is discharged directly from the treatment chamber and the fresh air is introduced directly into the treatment chamber. Thus, in previous prior art, the gases, which have different temperatures, must be mixed only within the treatment chamber. This often results in flow conditions within the treatment chamber that are undesirable and difficult to predict.

The present method has the advantage that the entire air processing is performed externally. Thus, the warmed and treated gaseous treatment medium is supplied to the treatment chamber at the desired temperature and does not have to be mixed only in the treatment chamber. This improves the flow conditions within the treatment chamber.

Before the recirculated gaseous treatment medium is warmed, a part of the recirculated gaseous treatment medium can be discharged as exhaust air.

This has the advantage that the part to be discharged as exhaust air is not warmed along with the rest. Thereby, energy is saved.

Fresh air can be supplied to the recirculated gaseous treatment medium before, during or after the warming of the recirculated gaseous treatment medium.

Fresh air can be supplied to the recirculated gaseous treatment medium after a part of the recirculated gaseous treatment medium has already been discharged as exhaust air. This is advantageous in that maximum humidity has already been withdrawn from the system.

The fresh air can be warmed and the warmed fresh air can be used to warm the recirculated gaseous treatment medium.

The fresh air can first be mixed with a combustion exhaust gas of a heating means, and this mixture can be supplied as a gaseous heating medium to the recirculated gaseous treatment medium and thus warm the latter.

The warming of the recirculated gaseous treatment medium can occur in a heating system.

The warmed gaseous treatment medium, mixed with fresh air, can be blown into the treatment chamber by mean of a blower means, the blower means being arranged downstream of the heating system in the flow direction.

This has the advantage that energy can be saved.

Further, the external air processing is advantageous in that the individual modules required for air processing, such as the heating system and the air circulation blower, can be set up at any optional position and can be exchanged or modified independent of the treatment chamber. For example, the individual modules can be set up in another room so that the exhaust air does not influence the system. Further, it is possible, for example, to silence the air circulation blower separately.

An air processing system for the processing of a gaseous treatment medium for a device, preferably a dryer, for the treatment of a preferably web-shaped material by means of a gaseous treatment medium, can be arranged externally of the treatment chamber of the device, the web-shaped material being treated in the treatment chamber. In the air processing system, fresh air can be supplied for the purpose of processing the gaseous treatment medium, and the gaseous treatment medium can be warmed by means of a heating system.

The air processing system further comprises an air circulation blower by which the gaseous treatment medium can be supplied to the treatment chamber, and by which the gaseous treatment medium, which has already been used for treatment, can be recirculated from the treatment chamber back to air processing system. The air circulation blower can be arranged downstream of the heating system in the flow direction.

The following is a detailed description of embodiments of the invention with reference to the drawings.

Figure 2:
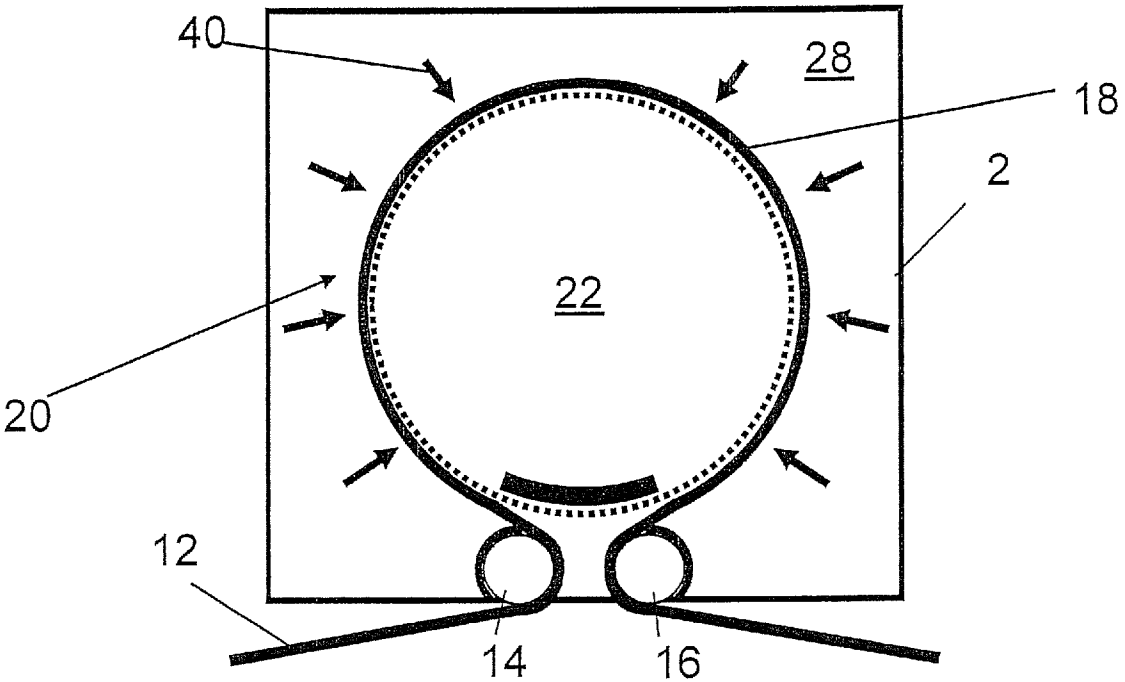
Figure 3:
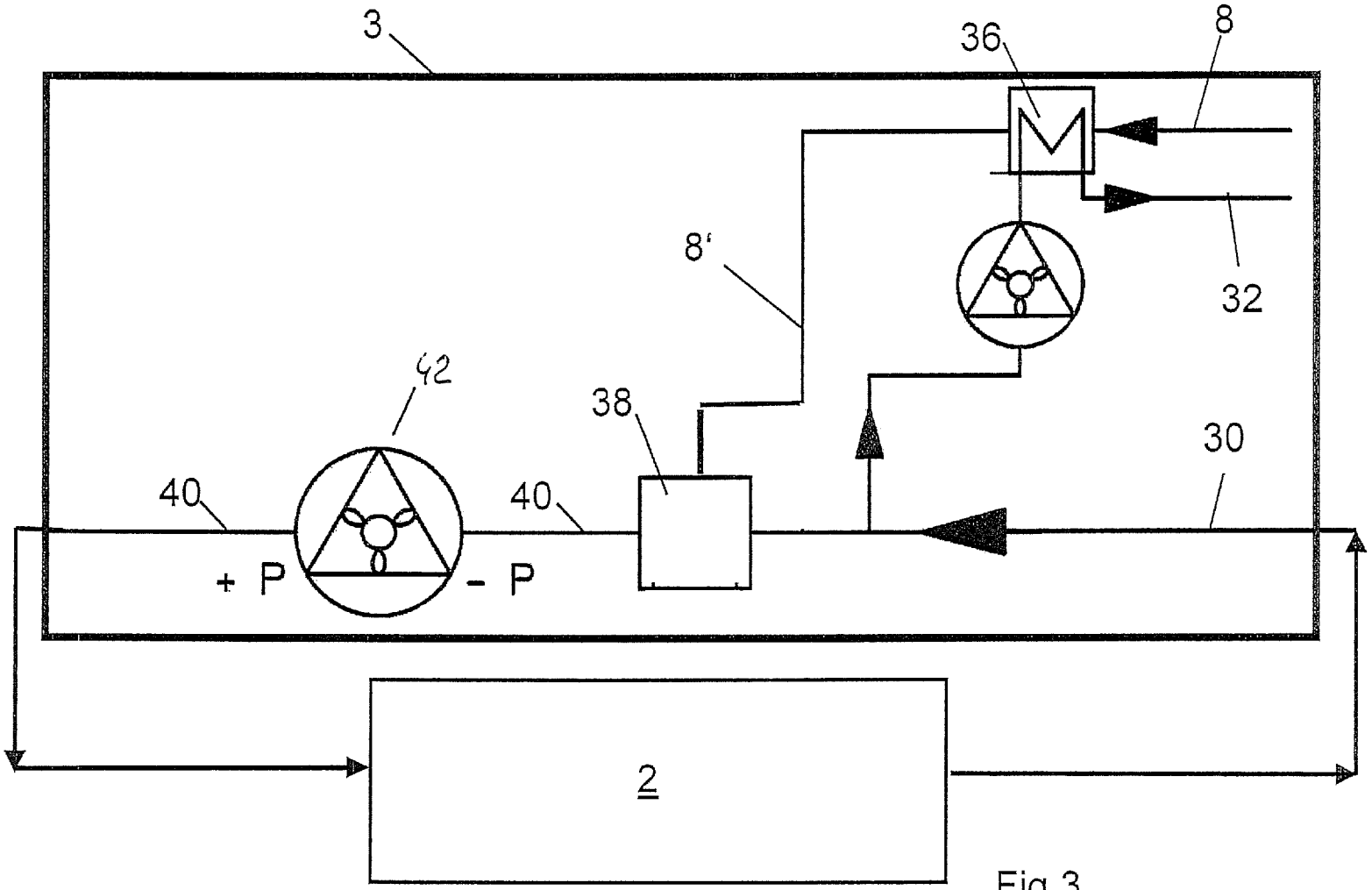
Figure 4:
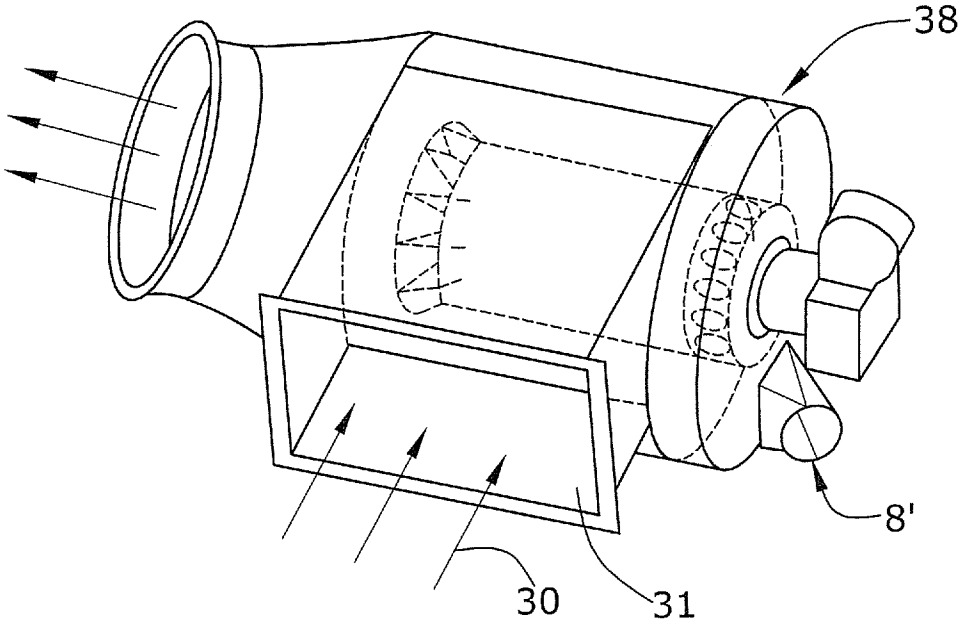
Figure 5:
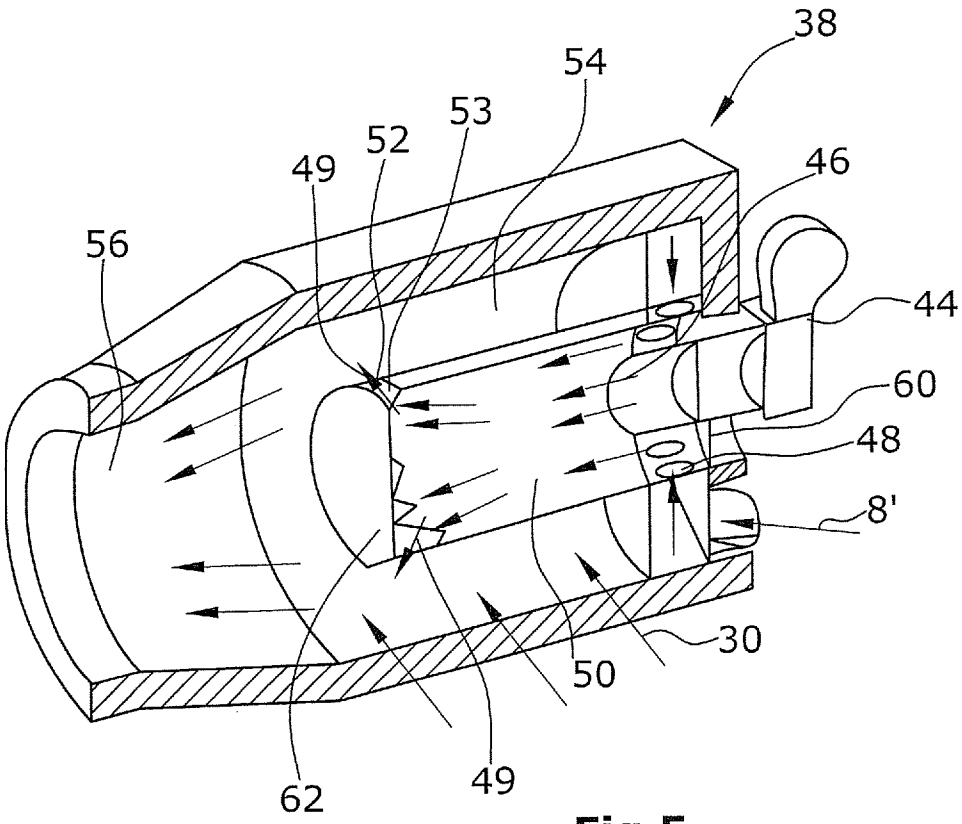

The Figures schematically show:

FIG. 1 an illustration of the guiding system for the gaseous treatment medium, FIG. 2 a side elevational view of the drying chamber, FIG. 3 an illustration of the air processing means, FIG. 4 a heating system, FIG. 5 a sectional view of the heating system of FIG. 4.

FIG. 1 is a schematical illustration of the guiding system for the gaseous treatment medium for a device for the treatment of a preferably web-shaped material by means of a gaseous treatment medium 40. In the embodiments illustrated, the device is a dryer 2. A warmed gaseous treatment medium 40 is supplied to a treatment chamber via a supply channel 6. In the embodiment illustrated, the treatment chamber is a drying chamber 28.

As is illustrated in more detail in FIG. 2, a preferably web-shaped material 12 is dried in the drying chamber 28, the gaseous treatment medium flowing through the web-shaped material 12, drying it in the process. This will be explained in more detail in the context of FIG. 2.

The gaseous treatment medium 30 already used for drying is discharged from the drying chamber 28 and is recirculated to an air processing means 3 via a channel 4. The gaseous treatment medium 30 already used for drying is colder than the warmed gaseous treatment medium 40 and, owing to the fact that it has absorbed the humidity of the web-shaped material 12, it has a higher humidity level than the warmed gaseous treatment medium 40.

A part of the recirculated gaseous treatment medium 30 is discharged in the air processing means 3. The reminder of the recirculated gaseous treatment medium 30 is mixed with fresh air and warmed and is supplied as a warmed gaseous treatment medium 40 to the drying chamber 28 via the supply channel 6.

The recirculated gaseous treatment medium is always the gaseous treatment medium 30 already used for treating or drying and recirculated from the treatment chamber or the drying chamber 28, which is recirculated to the air processing means 3. The gaseous treatment medium or the warmed gaseous treatment medium is the gaseous treatment medium 40 that is already processed and is supplied to the treatment chamber or the drying chamber 28 for treatment or drying purposes.

FIG. 2 is a schematic illustration of the drying chamber 28. The warmed gaseous treatment medium 40 is introduced into the drying chamber 28. A gas-permeable drum 20 is arranged in the drying chamber 28. The gas-permeable drum 20 comprises a gas-permeable drum shell 18.

A preferably web-shaped material 12 is introduced into the drying chamber 28 via a guide roller 14. The drum 20 transports this web-shaped material 12 in the direction of rotation of the drum 20 with the material placed on the drum shell 18. In this manner, a part of the drum shell 18 is always covered by a section of the web-shaped material 12. Owing to a vacuum prevailing in the interior 22 of the drum 20, the gaseous treatment medium 40 present in the treatment chamber 28 passes through the web-shaped material 12 and the gas-permeable drum shell 18 into the interior 22 of the drum 20. From the interior 22 of the drum 20, the gaseous treatment medium 30 already used for drying is, as already explained with reference to FIG. 1, supplied to an air processing means 3 via a channel 4. After the drying, the web-shaped material 12 is discharged from the drying chamber 28 via a second guide roller 16.

FIG. 3 illustrates an air processing means 3, which air processing means 3 merely is a collection of lines and individual modules that will be explained in detail hereunder.

The recirculated gaseous treatment medium 30 is discharged in part as exhaust air 32. This exhaust air 32 is supplied to a heat exchanger 36 before it is discharged. Further, fresh air 8 is supplied to the heat exchanger 36 and is warmed by the heat of the exhaust air 32.

The remainder of the gaseous recirculated treatment medium 30 is introduced into a heating system 38. Likewise, the fresh air 8' warmed by the heat exchanger 36 is supplied to the heating system 38. The heating system 38 will be explained in more detail with reference to FIGS. 4 and 5. From the heating system 38, the warmed gaseous treatment medium 40 exits and is recirculated to the drying chamber 28 via blower means 42 and the supply channel 6.

The heating system 38 is illustrated in more detail in FIGS. 4 and 5. The gaseous recirculated treatment medium 30 is supplied to a mixing chamber 54 via an opening 31. Similarly, a gaseous heating medium 49 warmed by a heating means is introduced into the mixing chamber, the gaseous heating medium 49 being adapted to be introduced into the mixing chamber 54 in such a manner that turbulences occur in the mixing chamber 54 as the gaseous heating medium 49 is introduced into the mixing chamber 54. Thereby, an intensive mixing of the gaseous heating medium 49 with the recirculated gaseous treatment medium 30 occurs. In the present embodiment, the heating means is a gas burner 44.

As illustrated in FIG. 5, when it is introduced into the mixing chamber 54, the gaseous heating medium 49 is deflected by guiding elements 53 such that turbulences occur in the mixing chamber 54 when the gaseous heating medium 49 is introduced into the mixing chamber 54. Preferably, the guiding elements 53 are blade or vane elements.

The gaseous heating medium 49 has been warmed by means of the gas burner 44. This is achieved by mixing combustion exhaust gases 46 of the gas burner 44 with the fresh air 8' already preheated. The mixture of combustion exhaust air 46 and fresh air 8' forms the above-mentioned gaseous heating medium 49. Mixing the combustion exhaust gases 46 and the fresh air 8' occurs in a pre-chamber 50. The fresh air 8' is introduced via an opening 48 along the circumference of the pre-chamber 50 at an end face 60 of the pre-chamber 50. At the end face 62 of the pre-chamber 50 opposite the end face 60, an opening 52 is provided through which the warmed gaseous heating medium 49 enters the mixing chamber 54.

The hot combustion exhaust gas 46 is introduced axially and centrally into the cylindrical pre-chamber 50. This is advantageous in that the hot combustion exhaust gas 46 is surrounded by fresh air 8' when it is introduced. Thereby, no heat is lost as waste heat.

Further, the pre-chamber 50 is arranged within the mixing chamber 54 so that also the exhaust heat from the pre-chamber 50 can be used to heat the gaseous media in the mixing chamber 54 and no heat is lost.

The mixing chamber 54 illustrated has a cylindrical interior. The gaseous treatment medium 30 is introduced tangentially into the cylindrical mixing chamber 54. Thereby, turbulences occur in the mixing chamber 54 when the gaseous treatment medium 30 is introduced into the mixing chamber 30. The gaseous recirculated treatment medium 30 is preferably introduced such that the turbulences rotate in a direction opposite to that of the turbulences of the gaseous heating medium 49 introduced into the mixing chamber 54. In this manner, the recirculated gaseous treatment medium 30 and the gaseous heating medium 49 are mixed very well. Instead of a tangential introduction of the gaseous recirculated treatment medium 30, it is alternatively also possible to provide guiding elements that cause turbulences when the gaseous treatment medium 30 is introduced.

As an alternative to the guiding elements 53 that cause turbulences in the mixing chamber 54 as the gaseous heating medium 49 is introduced into the mixing chamber 54, it may further also be provided that the gaseous heating medium 49 is also introduced tangentially into the cylindrical mixing chamber 54. The turbulences of the recirculated gaseous treatment medium 30 and the turbulence of the gaseous heating medium 49 should always rotate in opposite directions so that a more intensive mixing of the two gaseous media is achieved.

Further, it is possible in addition to introduce the fresh air 8' into the pre-chamber such that turbulences occur when the fresh air 8' is introduced into the pre-chamber. Further, the combustion exhaust gases 46 can be introduced into the pre-chamber such that turbulences occur when the combustion exhaust gas 46 is introduced into the pre-chamber 50. Likewise, the turbulences of the fresh air 8' and of the combustion exhaust gas 46 can rotate in different directions. This would also result in a better mixing.

A conically tapering channel 56 is arranged downstream of the mixing chamber 54 in the flow direction. The conically tapering channel increases the flow velocity of the gaseous treatment medium 40. The warmed gaseous treatment medium 40 can exit from the opening 48 and be recirculated to the drying chamber 28 via the supply channel 6.

Further, a flow straightener, not illustrated, can be arranged downstream of the mixing chamber 54 in the flow direction. The same may be a channel with flow guide plates oriented in the direction of the channel. As an alternative or in addition, screens or perforated plates may be provided as flow straighteners, the screens or plates being arranged in the cross-sectional surface area of a channel.

The invention claimed is:

1. A heating system for heating a gaseous treatment medium for a device for a treatment of a web-shaped material with the gaseous treatment medium, comprising:

a heater for producing a gaseous heating medium, a cylindrical pre-chamber having first and second ends, wherein the gaseous heating medium is introduced axially and centrally into the first end of the pre-chamber, and a mixing chamber surrounding the pre-chamber for mixing at least the gaseous heating medium and a recirculated gaseous treatment medium comprising the gaseous treatment medium recirculated from the device, wherein the gaseous heating medium is introduced into the mixing chamber in a region of the second end of the pre-chamber such that turbulences occur in the mixing chamber when the gaseous heating medium is introduced into the mixing chamber, the turbulences causing mixing of the gaseous heating medium with the recirculated gaseous treatment medium, wherein the mixing chamber comprises a cylindrical interior and is configured so that the recirculated gaseous treatment medium is introduced tangentially into the mixing chamber such that turbulences occur in the mixing chamber when the recirculated gaseous treatment medium is introduced into the mixing chamber and wherein the turbulences of the recirculated gaseous treatment medium rotate in a direction opposite to the turbulences of the gaseous heating medium introduced into the mixing chamber.

2. The heating system of claim 1, wherein the gaseous heating medium is deflected by guiding elements when the gaseous heating medium is introduced into the mixing chamber so that turbulences occur in the mixing chamber when the gaseous heating medium is introduced into the mixing chamber.

3. A method for heating a gaseous treatment medium for a device for the treatment of a web-shaped material with the gaseous treatment medium, comprising steps of:

recirculating a gaseous treatment medium already used for the treatment of the material to produce a recirculated gaseous treatment medium, introducing the recirculated gaseous treatment medium into a mixing chamber having a cylindrical interior, generating with a heater a warmed gaseous heating medium and passing the warmed gaseous medium axially and centrally into a first end of a cylindrical pre-chamber located within the interior of the mixing chamber;

introducing the warmed gaseous heating medium at a region of a second end of the pre-chamber into the mixing chamber to heat the recirculated gaseous treatment medium, the gaseous heating medium being introduced into the mixing chamber such that turbulences occur upon introduction that cause mixing of the gaseous heating medium with the recirculated gaseous treatment medium, wherein the mixing chamber is configured such that the recirculated gaseous treatment medium is introduced tangentially into the mixing chamber such that turbulences occur in the mixing chamber when the recirculated gaseous treatment medium is introduced into the mixing chamber and wherein the turbulences of the recirculated gaseous treatment medium rotate in a direction opposite to the turbulences of the gaseous heating medium introduced into the mixing chamber.

4. A device for the treatment of a web-shaped material with a gaseous treatment medium, comprising:

a treatment chamber through which the material to be treated is passed, the gaseous treatment medium present in the treatment chamber flowing through the material; and a heating system for heating the gaseous treatment medium, the heating system comprising a heating element, a cylindrical pre-chamber having first and second ends, wherein the gaseous heating medium is introduced axially and centrally into the first end of the pre-chamber, and a mixing chamber surrounding the pre-chamber;

wherein the gaseous heating medium and a recirculated gaseous treating medium comprising the gaseous treatment medium recirculated from the treatment chamber are mixed in the mixing chamber;

wherein the gaseous heating medium is introduced at a region of the second end of the pre-chamber into the mixing chamber such that turbulences occur in the mixing chamber when the gaseous heating medium is introduced into the mixing chamber, the turbulences causing a mixing of the gaseous heating medium with the recirculated gaseous treatment medium, wherein the mixing chamber comprises a cylindrical interior and is configured so that the recirculated gaseous treatment medium is introduced tangentially into the mixing chamber such that turbulences occur in the mixing chamber when the recirculated gaseous treatment medium is introduced into the mixing chamber and the turbulences of the recirculated gaseous treatment medium rotate in a direction opposite to the turbulences of the gaseous heating medium introduced into the mixing chamber.

5. The device of claim 4, wherein the heating system is arranged outside the treatment chamber.

6. A method for heating a gaseous treatment medium for a device for the treatment of a web-shaped material with the gaseous treatment medium, comprising steps of:

introducing a heated gaseous treatment medium into a treatment chamber in which a drum with a gas-permeable drum shell is arranged on which the web-shaped material to be treated is placed, the heated gaseous treatment medium flowing through the web-shaped material and the gas-permeable drum shell into the interior of the drum, discharging the gaseous treatment medium, which has already been used for treatment, as a recirculated gaseous treatment medium from the interior of the drum and from the treatment chamber to be processed externally, processing the recirculated gaseous treatment medium, the recirculated gaseous treatment medium being processed by being mixed with and warmed up by warmed fresh air, supplying the processed recirculated gaseous treatment medium to the treatment chamber, wherein a warming of the recirculated gaseous treatment medium is effected in a heating system, the heating system comprising:

a heater for producing a gaseous heating medium, and a cylindrical pre-chamber having first and second ends, wherein the gaseous heating medium is introduced axially and centrally into the first end of the pre-chamber, and a mixing chamber surrounding the pre-chamber for mixing at least the gaseous heating medium warmed by the heater and the recirculated gaseous treatment medium, wherein the gaseous heating medium is introduced into the mixing chamber at a region of the second end of the pre-chamber such that turbulences occur in the mixing chamber when the gaseous heating medium is introduced into the mixing chamber, the turbulences causing mixing of the gaseous heating medium with the recirculated gaseous treatment medium, wherein the mixing chamber has a cylindrical interior and is configured so that recirculated gaseous treatment medium is introduced tangentially into the mixing chamber such that turbulences occur in the mixing chamber when the recirculated gaseous treatment medium is introduced into the mixing chamber and wherein the turbulences of the recirculated gaseous treatment medium rotate in a direction opposite to the turbulences of the gaseous heating medium introduced into the mixing chamber.

7. The method of claim 6, further including discharging a part of the recirculated gaseous treatment medium as exhaust air before the recirculated gaseous treatment medium is warmed.

8. The method of claim 7, further including using the exhaust air to warm the fresh air.

9. The method of claim 6, further including first mixing fresh air with a combustion exhaust gas of a heater, and supplying the mixture of fresh air and combustion exhaust gas to the recirculated gaseous treatment medium as a gaseous heating medium.

10. The method of claim 6, wherein a blower is arranged downstream of the heating system and the method further includes blowing the gaseous treatment medium warmed and mixed with fresh air into the treatment chamber by the blower.

* * * * *